US006143964A

United States Patent [19]

Chen

[11] Patent Number: 6,143,964

[45] Date of Patent: Nov. 7, 2000

[54] UNIVERSAL BODY PAD FOR STRING MUSICAL INSTRUMENT

[75] Inventor: Chien-Tai Chen, 8807 Fox Hills Trail, Potomac, Md. 20854

[73] Assignee: Chien-Tai Chen, Potomac, Md.

[21] Appl. No.: 09/392,222

[22] Filed: Sep. 9, 1999

[51] Int. Cl.[7] ..... G10D 1/02

[52] U.S. Cl. ..... 84/280; 84/279; 84/281; 84/453

[58] Field of Search ..... 84/279, 280, 281, 84/453

[56] References Cited

U.S. PATENT DOCUMENTS

| | | | |
|---|---|---|---|
| 409,842 | 8/1889 | Hoelscher | 84/281 |
| 1,377,571 | 5/1921 | Fisher | 84/281 |

*Primary Examiner*—David Martin
*Assistant Examiner*—Shih-Yung Hsieh
*Attorney, Agent, or Firm*—Armstrong, Westerman, Hattori, McLeland & Naughton

[57] ABSTRACT

A universal body pad for string musical instruments such as violins or violas. The pad is made of a unitary body having a cushion portion and an arm portion that conform to a player's body. Both upper and lower surfaces of the cushion and arm portions of the pad frictionally engage with the player's apparel and shoulder, respectively. The upper and lower surfaces can be either smooth or uneven. The cushion portion is curved at its upper surface and recessed at its lower surface to support the instrument and allow non-slip contacts with the player's body or undergarment and the player's apparel or outer garment. The arm portion is extended from the cushion portion to allow additional non-slip contacts with the player's body undergarment and the player's apparel or outer garment. An additional layer, which is made of same or different material and configured with same or different surface pattern variations, may be added to the pad at its lower and upper surfaces for extra comfort and/or friction.

19 Claims, 5 Drawing Sheets

UNIVERSAL BODY PAD FOR STRING MUSICAL INSTRUMENT

BACKGROUND OF THE INVENTION

1. Field of the Invention

The present invention generally relates to a body pad for musical instruments. More particularly, the present invention relates to a universal body pad for string musical instruments such as violins or violas.

2. Description of the Related Art

Conventional shoulder rests or pads for use with string musical instruments belonging to the violin or viola family are well known, in which the shoulder rests or pads are attached to or positioned against the back of the instruments, and serve to support the instruments comfortably on the player's shoulder. Conventional shoulder rests or pads are often constructed to withstand the stress of continued usage, and may be mounted onto the instrument to assist the player in keeping the instrument in a comfortable position between the jaw bone and the collar bone.

However, there are many disadvantages associated with the conventional shoulder pads or rests. For instance, the limited axial movement or lateral inclination of the instrument with conventional pads or rests is such that the player is often subjected to a relatively high degree of strain, inflexibility, and stiffness while holding the instrument and playing. Additionally, the adherence of the conventional pads or rests on the instrument creates negative acoustic influences due in part to the vibration of the instrument created by the contact points with the instrument. Very often the conventional pads or rest can cause the player to be engaged in a fixed posture of the upper body and can be detached from the instrument while the player is playing the instrument.

SUMMARY OF THE INVENTION

Accordingly, it is therefore an object of the present invention to provide a secure body pad for supporting a string musical instrument on a player's body without creating a negative acoustic influence.

It is still a further object of the present invention to provide a secure body pad for a string musical instrument that is conveniently hidden from public view and yet allows great flexibility in the axial movement or lateral inclination of the instrument.

It is yet still another object of the present invention to provide a secure body pad for a string musical instrument that is simple in construction, economical in manufacture, and durable in use.

The body pad of the present invention includes a unitary body having a cushion portion and an arm portion that conform to a player's shoulder. The lower surface of the body pad is adapted to engage the player's body or undergarment and an upper surface adapted to engage a player's apparel or outer garment, wherein the cushion portion is curved at the upper surface and recessed at the lower surface for securing the cushion portion on between a player's collarbone and the player's apparel or outer garment, and the arm portion is extended from the cushion portion for securing the arm portion between a player's trapezius and the player's apparel or outer garment.

In particular, the body pad is naturally secured on the player's shoulder by the natural weight of the outer garment or apparel and an undergarment, if any.

Moreover, the frictional coefficients of the upper and lower surfaces of the unitary body may be different, and one or more support layers conforming to unitary body's shape may be disposed on the lower and upper surfaces of the pad for extra comfort and/or friction.

Other objects and advantages of the present invention will become apparent from a reading of the following detailed description of the preferred embodiments taken in connection with the accompanying drawings.

DETAILED DESCRIPTION OF THE PREFERRED EMBODIMENTS

Figure 1:
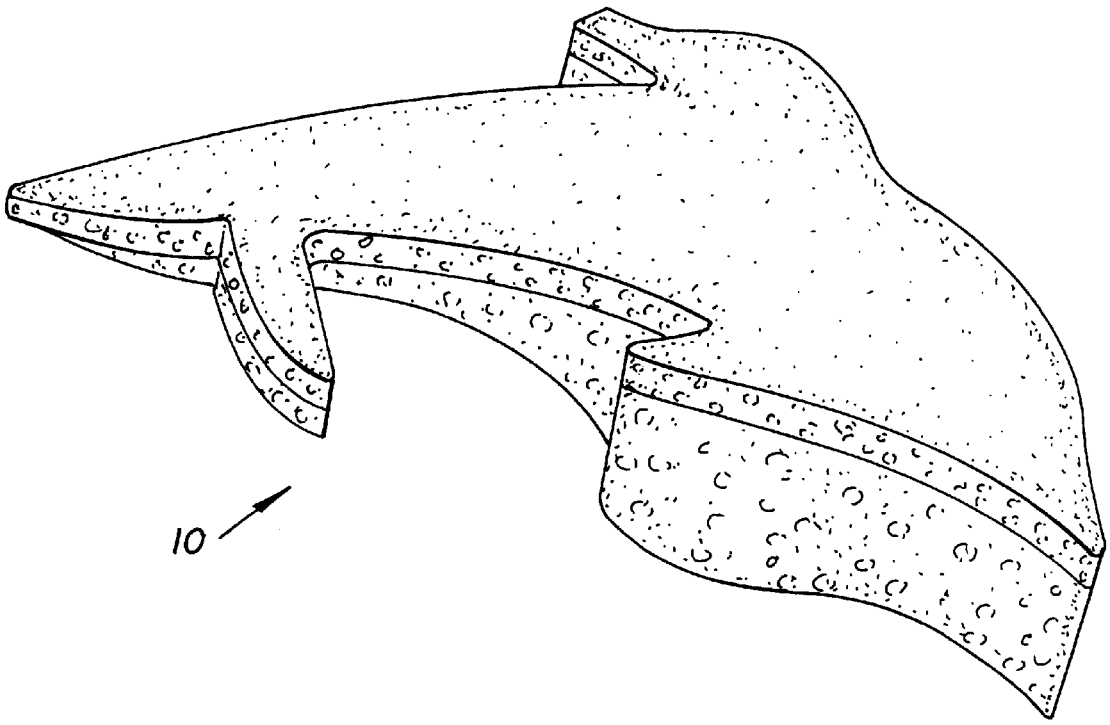
FIG. 1 is a perspective view of a universal body pad according to a first embodiment of the present invention.
Figure 2:
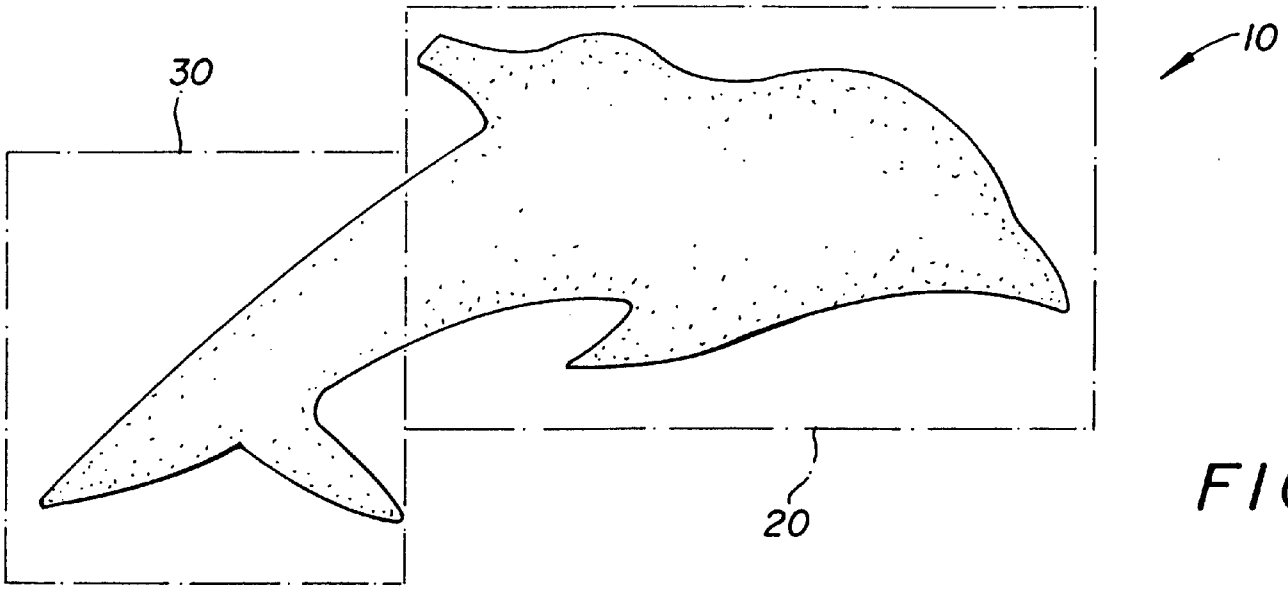
FIG. 2 is a top view of the body pad of FIG. 1.
Figure 3:
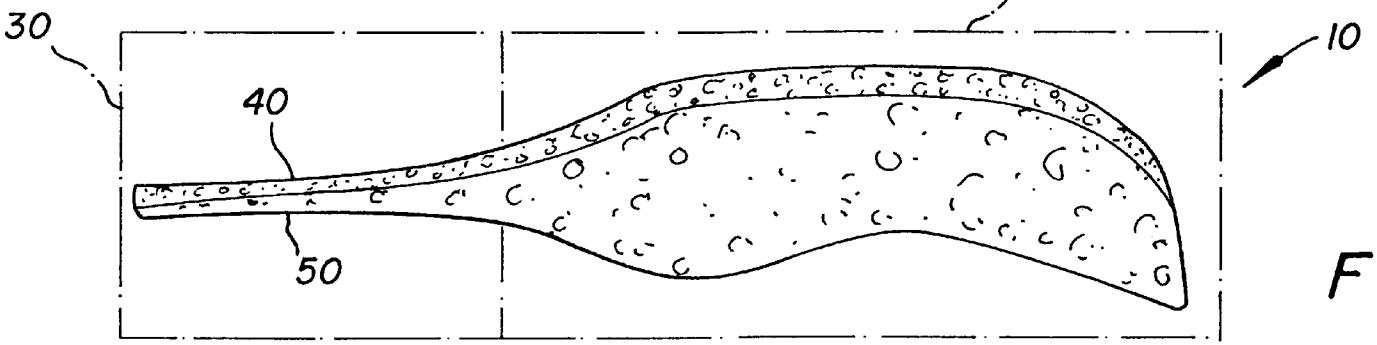
FIG. 3 is a side view of the body pad of FIG. 1.
Figure 4:
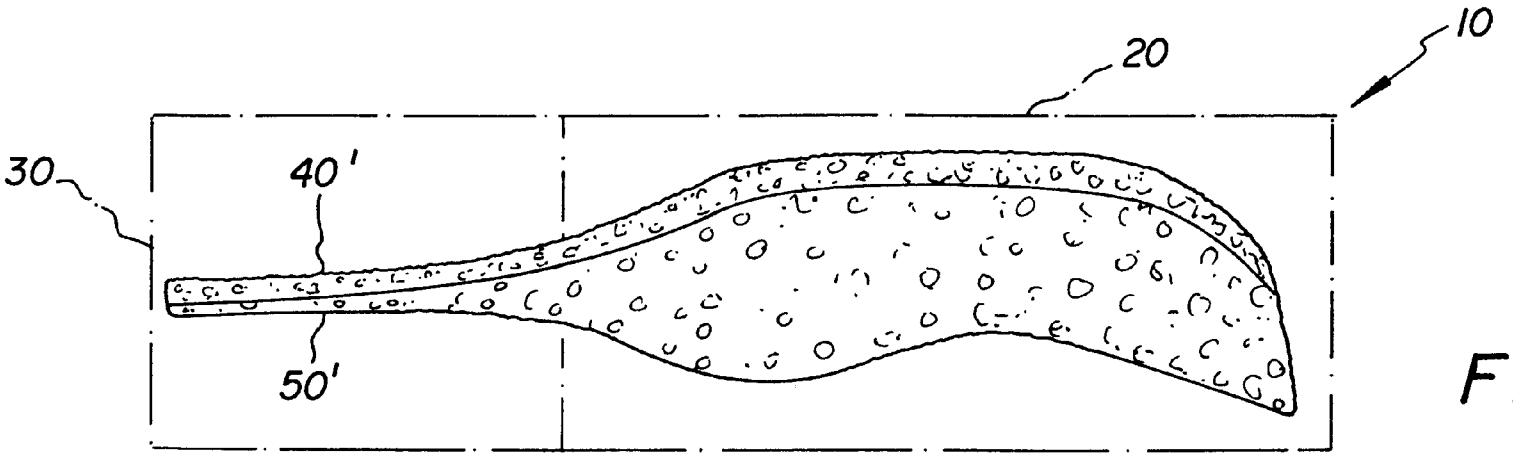
FIG. 4 is a side view of a universal body pad according to a second embodiment of the present invention.

With reference now to the drawings and in particular to FIGS. 1–3 thereof, the general configuration of a body pad 10 for supporting a string musical instrument (not shown) in accordance with the present invention is characterized principally by a cushion portion 20 and an arm portion 30 which securely engage a player's shoulder and apparel while providing support to the string musical instrument. In the illustrated embodiment, the pad 10 is made from a cellulose material or other suitable material, preferably a sponge or foam, to allow conformity to the player's body and provide solid non-slip contacts with the player's shoulder and apparel. The upper and lower surfaces 40 and 50 of the pad 10 as shown in FIGS. 2 and 3 are smooth. However, in an alternative embodiment as shown in FIG. 4, the upper and lower surfaces 40' and 50' of the body pad 10 can each be configured with same or different surface pattern variations, such as smooth or uneven patterns, to obtain same or different frictional coefficients.

In FIG. 3, the cushion portion 20 is curved at the upper surface 40 and concave at the lower surface 50 for securing the cushion portion atop the collar bone of the player's body, which may be covered by an undergarment, and beneath a player's apparel or outer garment. The arm portion 30 is extended from the cushion portion for securing the arm portion along the trapezius of the player's body, which may be covered by an undergarment, and beneath the player's apparel or outer garment. Additionally, the thickness of the cushion portion is generally larger than the arm portion, and both the cushion and arm portions of the pad generally have varying widths from one end to the other end.

For convenience in manufacture, the pad 10 is of an unitary structure and made from the same material. However, in yet another embodiment of the present invention as shown in FIG. 5, the pad may include one or more cushion layers 60 attached thereto.

Figure 5:
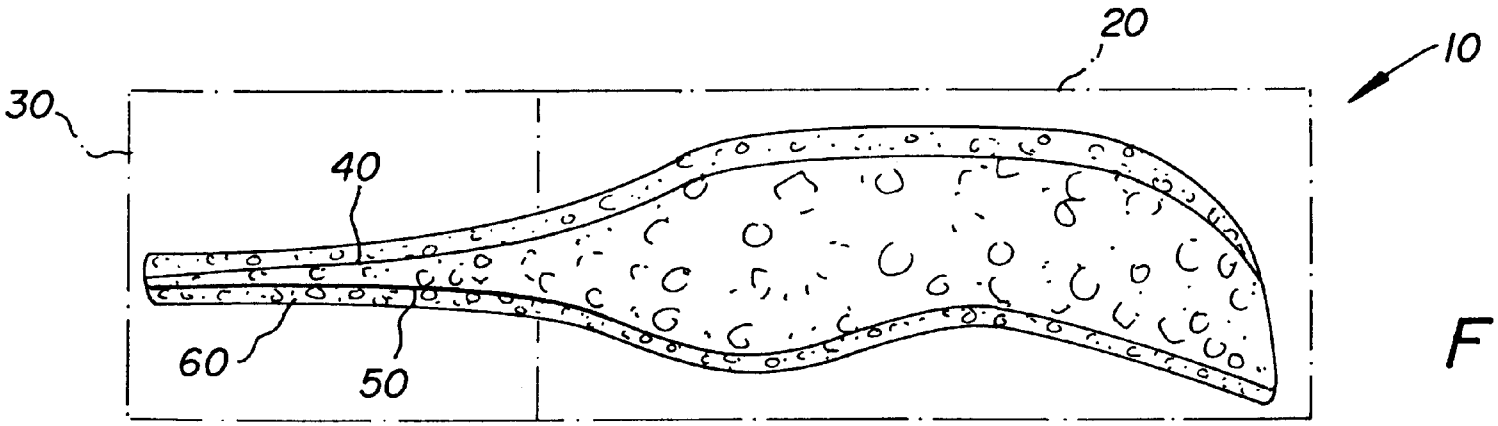
FIG. 5 is a side view of a universal body pad according to a third embodiment of the present invention.

The layer 60 as shown in FIG. 5 is adhered to the pad 10 at its lower and upper surfaces 40 and 50 for additional comfort and/or friction. The cushion 60 can be made of same or different material from the pad 10. The layer 60 can be also be configured with same or different surface pattern variations, such as smooth or uneven patterns, to obtain same or different frictional coefficients.

Figure 6A:
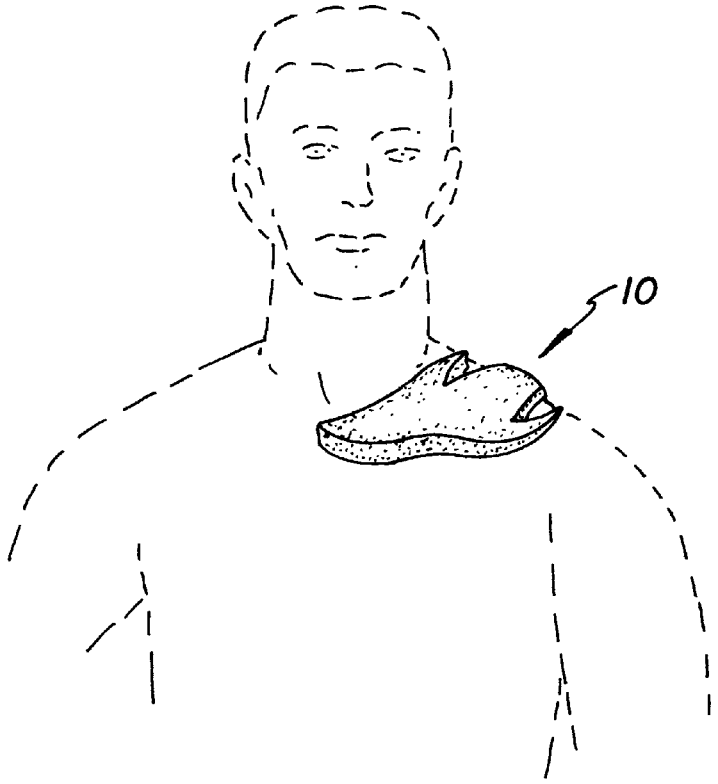
FIG. 6*a* is a front view showing the manner in which the body pad is rested upon a player's shoulder.
Figure 6B:
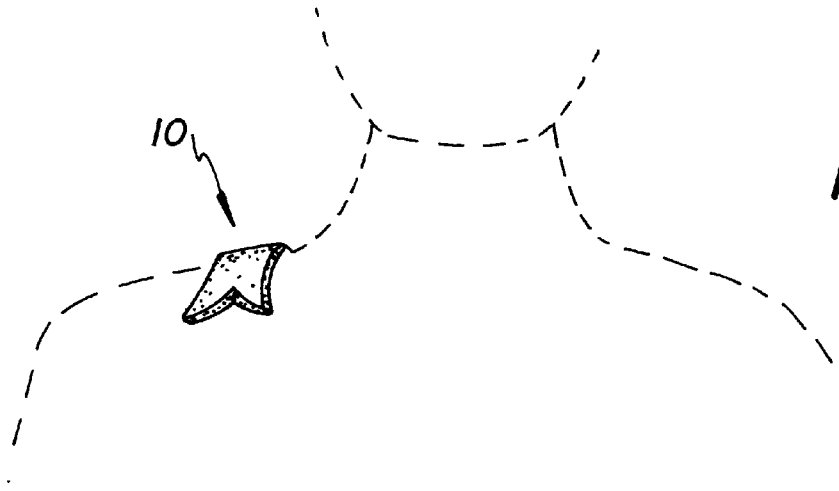
FIG. 6*b* is a rear view showing the manner in which the body pad is rested upon a player's shoulder.

FIGS. 6*a* and 6*b* illustrate the manner in which the body pad 10 is directly rested upon a player's shoulder. As shown in FIG. 6*a,* the cushion portion of the body pad 10 covers a portion of the player's collar bone. FIG. 6*b* shows a portion of the player's trapezius covered by the arm portion of the body pad 10. If the player is wearing an undergarment, then the body pad will frictionally engage the player's shoulder through the undergarment.

Figure 7A:
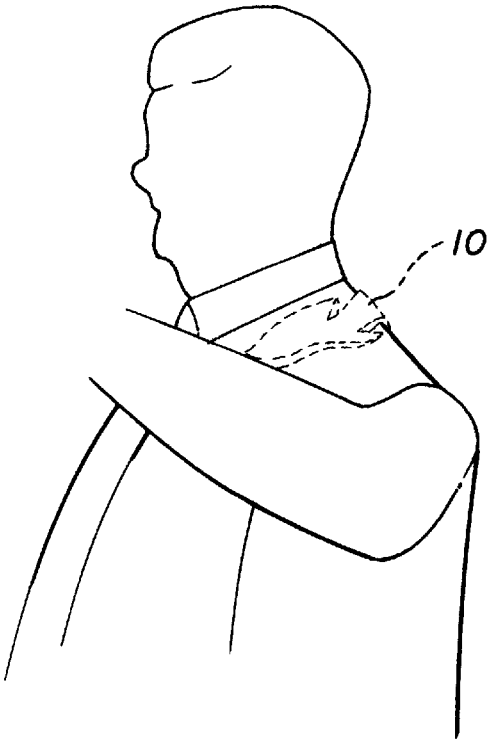
FIG. 7*a* is a perspective view showing the approximate location of the body pad on the player's shoulder.
Figure 7B:
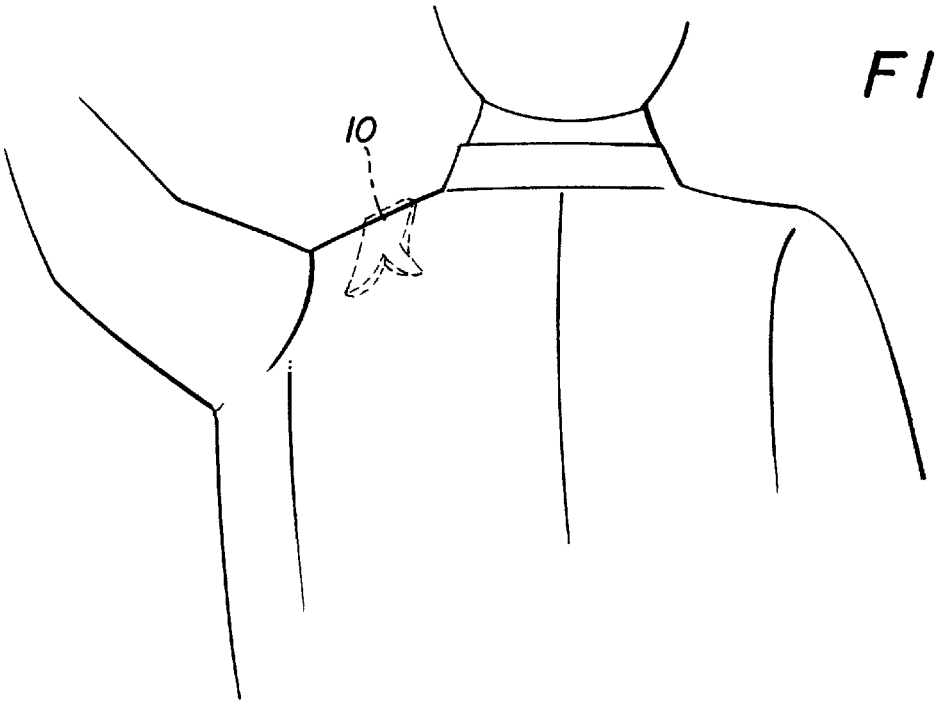
FIG. 7*b* is a rear view showing the approximate location of the body pad on the player's shoulder.

FIGS. 7*a* and 7*b* show the approximate location of the body pad 10 on the player's shoulder. An advantage of the described body pad is that by positioning of the pad beneath the player's apparel or outer garment and along a player's shoulder as shown in FIGS. 7*a* and 7*b,* the playing position of the instrument can be changed or modified without disturbing the support position of the pad. Additionally, since the body pad is not in direct contact with the instrument, the tone or sound of the instrument is not altered or degraded by the pad.

Yet another advantage of the pad is that it can be conveniently made into different sizes to fit a player's shoulder frame, e.g., two sizes can be provided, one "small" for a player with a small shoulder frame and the other "large" for use by a player with a large shoulder frame. Likewise, the pad can also be conveniently made into different shapes, e.g., a dolphin shape, for aesthetic appeals.

Other embodiments of the present invention will be apparent to those skilled in the art upon consideration of the specification and practice of the present invention disclosed herein. It is intended that the specification and examples be considered as exemplary only, with a true scope of the present invention being indicated by the following claims.

What is claimed is:

1. A body pad for supporting a string musical instrument comprising:

a unitary body having a cushion portion and an arm portion that conform to a player's shoulder, said unitary body having a lower surface adapted to engage a player's body or undergarment and an upper surface arranged to engage a player's apparel or outer garment, wherein said cushion portion is curved at said upper surface and recessed at said lower surface, said arm portion is extended from said cushion portion, and a thickness of said cushion portion is different than said arm portion.

2. The body pad of claim 1, wherein said cushion portion is secured between a player's collarbone and said player's outer garment or apparel, or between a portion said undergarment covering said player's collarbone and said player's outer garment or apparel.

3. The body pad of claim 2, wherein said arm portion is secured between a player's trapezius and said player's outer garment or apparel, or between another portion of said undergarment covering said player's trapezius and said player's outer garment or apparel.

4. The body pad of claim 1, wherein said thickness of said cushion portion is larger than said arm portion, and said unitary body is made from a flexible spongy material.

5. The body pad of claim 1, wherein said unitary body has varying widths from one end thereof to the other end, and said upper surface is uneven or notched.

6. The body pad of claim 1, wherein frictional coefficients of said upper surface and said lower surface are different.

7. A body pad for supporting a bowed string musical instrument comprising:

a unitary body having a cushion portion and an arm portion that conform to a player's shoulder, said unitary body having an uneven lower surface for frictionally engaging a player's body or undergarment and an uneven upper surface for frictionally engaging a player's apparel or outer garment, wherein said cushion portion is curved at said upper surface and recessed at said lower surface, and said arm portion is extended from said cushion portion.

8. The body pad of claim 7, wherein said cushion portion is secured between a player's collarbone and said outer garment or apparel, or between a portion of said undergarment covering said collarbone and said outer garment or apparel.

9. The body pad of claim 8, wherein said arm portion is secured between a player's trapezius and said apparel or outer garment, or between another portion of said undergarment covering said trapezius and said apparel or outer garment.

10. The body pad of claim 7, wherein a thickness of said cushion portion is larger than said arm portion, and said unitary body is made from a flexible spongy material.

11. The body pad of claim 7, wherein said unitary body has varying widths from one end thereof to the other end.

12. The body pad of claim 7, wherein frictional coefficients of said upper surface and said lower surface are different.

13. A body pad for supporting a string musical instrument comprising:

a unitary body having a cushion portion and an arm portion that conform to a player's shoulder, said unitary body having a lower surface adapted to engage a player's body or undergarment and an upper surface arranged to engage a player's apparel or outer garment; and one or more support layers disposed on said lower surface and said upper surface, said one or more support layers conforming to a shape of said unitary body, wherein said cushion portion is curved at said upper surface and recessed at said lower surface, said arm portion is extended from said cushion portion, and a thickness of said cushion portion is different than said arm portion.

14. The body pad of claim 13, wherein said cushion portion is secured between a player's collarbone and said apparel or outer garment, or between a portion of said undergarment covering said collarbone and said apparel or outer garment.

15. The body pad of claim 14, wherein aid arm portion is secured between a player's trapezius and said apparel or outer garment, or between another portion of said undergarment covering said trapezius and said player's apparel or outer garment.

16. The body pad of claim 13, wherein said thickness of said cushion portion is larger than said arm portion, and said unitary body or said one or more support layers are made from a flexible spongy material.

17. The body pad of claim 13, wherein said unitary body has varying widths from one end thereof to the other end.

18. The body pad of claim 17, wherein surfaces of said support layers are uneven or notched.

19. The body pad of claim 13, wherein frictional coefficients of said one or more support layers are different.

* * * * *